US006474135B1

(12) United States Patent
Clauer et al.

(10) Patent No.: US 6,474,135 B1
(45) Date of Patent: Nov. 5, 2002

(54) LASER PEENING TO PROVIDE DESIGN CREDIT FOR IMPROVED FATIGUE PROPERTIES

(75) Inventors: Allan Clauer, Worthington, OH (US); Jeff Dulaney, Dublin, OH (US)

(73) Assignee: LSP Technologies, Inc., Dublin, OH (US)

( * ) Notice: Subject to any disclaimer, the term of this patent is extended or adjusted under 35 U.S.C. 154(b) by 0 days.

(21) Appl. No.: 09/443,812

(22) Filed: Nov. 19, 1999

(51) Int. Cl.[7] ..... G01P 15/00

(52) U.S. Cl. ..... 73/12.01

(58) Field of Search ..... 73/11.02, 12.01; 219/121.83, 121.6, 121.86, 121.84, 121.85; 148/565; 427/554, 457

(56) References Cited

U.S. PATENT DOCUMENTS 5,948,293 A * 9/1999 Somers et al. ..... 73/11.02
6,094,260 A * 7/2000 Rockstroh et al. ..... 356/35.5
6,159,619 A * 12/2000 Rockstroh et al. ..... 428/610

* cited by examiner

*Primary Examiner*—Benjamin R. Fuller
*Assistant Examiner*—Octavia Davis
(74) *Attorney, Agent, or Firm*—Randall J. Knuth

(57) ABSTRACT

A method of determining and utilizing the improved properties of a solid material that has been subjected to laser shock processing includes the steps of determining a set of desired fatigue tolerances for a work piece, utilizing a known design credit based on enhanced fatigue tolerances due to laser shock processing, and subsequently determining a base material and set of tolerances that meet the set of desired fatigue tolerances for the work piece, with adjustments being made for design credit.

19 Claims, 2 Drawing Sheets

LASER PEENING TO PROVIDE DESIGN CREDIT FOR IMPROVED FATIGUE PROPERTIES

BACKGROUND OF THE INVENTION

1. Field of the Invention

The present invention relates to a method of determining and utilizing the improved properties of solid materials that are subjected to shock waves, or laser peened, and more particularly, to a method of designing a work piece whereby an ascertainable design credit is calculated and utilized for materials subjected to laser shock peening, the design credit being due to the enhanced mechanical properties such as hardness, high cycle fatigue life, and fatigue strength.

2. Description of the Related Art

Treating surfaces with impacts, or "peening" solid materials is well known in the art and is an accepted process for improving the fatigue, hardness, and corrosion resistance properties of materials. Several methods of such surface treatment exist including the use of vibropeening, burnishing, shot peening, and laser shock processing (or laser shock peening—hereinafter simply referred to as "laser shock processing").

The use of vibropeening, burnishing, and shot peening have long been utilized, but have significant disadvantages. Vibropeening and burnishing are limited to treating simple part geometries. The treatment of notches, complex curved surfaces, and cavities is generally not possible because of the difficulty of applying the tooling to the surface for reproducible, effective treatment.

In shot peening, many small shot or beads are directed at a high speed against a surface of the material. This peening process provides unpredictable results due to the inconsistent nature of firing the shot, and the shot or beads sometimes escape from the treatment equipment and scatter into the surrounding area. Since the shot or beads might get into surrounding machinery and cause damage, shot peening usually can not be used in a manufacturing line. Additionally, such shot peening can ordinarily not be used on machined surfaces without a high likelihood of creating surface roughness outside of specifications. Furthermore, shot peening is inconsistent in achieving uniform characteristics in the resulting solid material.

Laser shock processing has several advantages over the prior art. Laser shock processing can occur on a manufacturing line without danger to surrounding equipment, is easily focused on preselected surface areas, and further, provides deeper compressive residual stresses than other surface treatment processes. Furthermore, laser shock processing can be conducted in high temperature and high vacuum environments. Non-planar surfaces and complex geometries are easily treated with laser shock processing. Most importantly, laser shock processing yields consistent, predictable mechanical properties in the resulting solid material. Resulting hardness, strength, high cycle fatigue properties, and fatigue strength in a work piece can be reproducibly attained with laser shock processing.

Laser shock processing encompasses all of the advantages of the prior art methods of peening solid materials, and provides several additional advantages, including being repeatedly attainable, and consistently measurable. Formerly, engineers and manufacturers could not rely on the enhanced properties of shot peening in their design specifications. The varying results prohibited engineers and manufacturers from fully utilizing a consistent enhancement of physical properties in the solid material.

SUMMARY OF THE INVENTION

The present invention sets forth a method of designing a work piece made of a solid material, given the precise reliability of laser shock processing results. The method includes the steps of determining a set of desired fatigue properties and tolerances for the work piece, determining a first base material and a first set of properties that would satisfy the set of desired fatigue properties, determining a second base material and a second set of properties that fall short of the set of desired fatigue properties, determining a design credit for the second base material based on enhanced fatigue properties due to a laser shock peening process, and using the laser shock peened second base material in a work piece, wherein the second base material has an enhanced set of properties that satisfy the set of desired fatigue properties by incorporating the design credit.

The present invention, in another form thereof, comprises a method of designing an article of manufacture having material properties comprising the steps of determining a set of desired fatigue properties for the article utilizing a known design credit based on enhanced fatigue properties due to laser shock processing, and determining a base material and set of properties that meet that set of desired fatigue properties for the article, with adjustments being made for design credit.

The invention, in yet another form thereof, pertains to a method of designing an article of manufacture having material properties, the method comprising the steps of determining a set of desired properties for the article based on preliminary design criteria, utilizing a known design credit based on enhanced properties of candidate materials for the article due to laser shock processing, determining an allowable increase in the design requirements for the article incorporating the design credit for the candidate materials, selecting the candidate material giving the highest allowable increase in the design requirements incorporating the design credit, and using the selected candidate material in the work piece.

In one embodiment of the invention, the design credit comprises the difference between the non-laser shock processed material properties and the desired design fatigue properties, wherein the laser-shock treated fatigue properties are higher than the design properties. The invention, in another embodiment thereof, defines the design credit as the difference between the non-laser shock treated material properties and the laser shock processed material properties, wherein the property increase is not quite as high as the desired design properties, but is still acceptable for the application.

It is an advantage of this invention that once the enhanced fatigue and mechanical properties of a laser-shock treated solid material are determined, corresponding results can be expected from all future laser shock processing of the solid material. Because of the highly controllable and reproducible effects of laser shock processing, the expected mechanical properties of a given solid material can be calculated both before and after the laser peening process.

It is a further advantage of the present invention that an ascertainable quantity of the solid material is saved in the making of each work piece due to the fact that the desired mechanical properties such as hardness, high cycle fatigue life, fatigue strength, and corrosion fatigue resistance can be achieved using less material. Alternately, a different (and optimally less expensive) material may be identified by this method, the alternate material possessing the desired mechanical properties after being laser shock processed.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Laser shock processing is an effective method of increasing fatigue in metals by treating fatigue critical regions. For a more thorough background in the prior history of laser shock processing, a reference can be made to U.S. Pat. Nos. 5,131,957 and 5,741,559, such patents explicitly hereby incorporated by reference.

Figure 1:
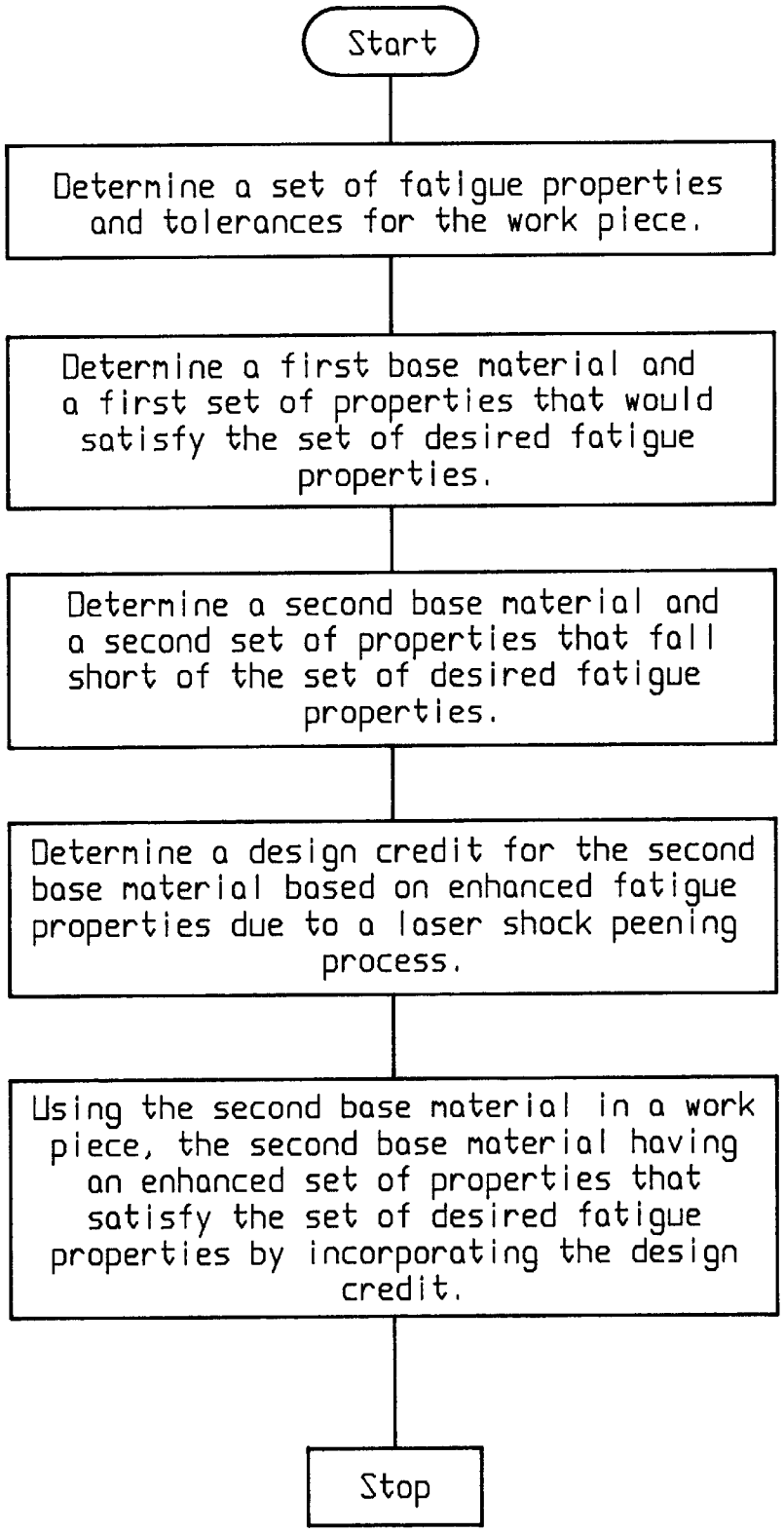
FIG. 1 is a flow chart indicating the method utilized in the present invention.

As shown in flow chart form in FIG. 1, the present invention relates to a method of designing a work piece, using the precise reliability of laser shock processing results. The method includes the steps of determining a set of desired fatigue properties and tolerances for the work piece, determining a first base material and a first set of properties that would satisfy the set of desired fatigue properties, determining a second base material and a second set of properties that fall short of the set of desired fatigue properties, determining a design credit for the second base material based on enhanced fatigue properties due to a laser shock peening process, and using the laser shock peened second base material in a work piece, wherein the second base material has an enhanced set of properties that satisfy the set of desired fatigue properties by incorporating the design credit.

In determining the desired fatigue properties and tolerances for the work piece, considerations are made of the mechanical properties required for the use of the work piece, such as hardness, strength and fatigue strength. Once those desired mechanical properties are ascertained and quantifiable, the next step is to determine a first base material and a first set of properties that would satisfy the set of desired fatigue properties, and a second base material and a second set of properties that would fall short of the set of desired fatigue properties.

Base materials and their associated properties are well known in the art. Engineers and manufacturers are confined to certain minimum tolerances for work piece thicknesses and dimensions based on the physical and mechanical properties of the base material.

With laser shock processing, however, base materials can be strengthened to take on enhanced mechanical properties, therefore permitting the use of base materials that were originally inferior in mechanical properties and/or permitting physical tolerances that previously were not possible because of the desired fatigue tolerances of the design. The difference between the magnitude of the properties of the non-laser shock treated base material and the magnitude of the properties of the laser shock treated material specified in the design of the workpiece is known in the art as the design credit taken for the process providing the increase in properties. In order to take this property increase as a design credit in the use of the treated material in the work piece, the property enhancement must be reproducible, reliable, and consistent. Because laser shock processing can produce relatively precise resulting properties, engineers and manufacturers can count on utilizing less material and/or utilizing an inferior material when they utilize the laser shock process.

Design credits allow the use of inferior and, therefore less expensive materials, the use of a smaller quantity of material, and/or an increase in the performance of the system containing the work piece. This design credit therefore results in a savings to the company, increased versatility in the manufacture of the work piece, and more competitive products.

Laser shock processing provides a distinct advantage above prior art forms of peening, in that it provides a consistent result that engineers and manufacturers can depend upon. Although peening by other methods formed desirable effects, those effects were in large part inconsistent.

A detailed analysis of a design credit could be defined as follows. A set of design criteria are set forth by a design team. Knowing the base properties of applicable materials, an engineer will select a material that can satisfy the requisite design criteria while still yielding a functional work piece. If two or more base materials can satisfy the design requirements, typically the least expensive material will be selected, notwithstanding outside considerations.

The value of the design credit can be determined by charting the amplitude of stress versus the number of cycles to failure for both the base material and the material after laser shock peening. The resulting graphs are termed the design curves for the material in the two conditions. It is the essential purpose of this invention to determine a precise amount by which the design curve has been altered or raised for a base material by the laser shock process. It is further a step of this invention to then apply at least a percentage of that design credit to the work piece tolerance and base material property determinations.

Figure 2:
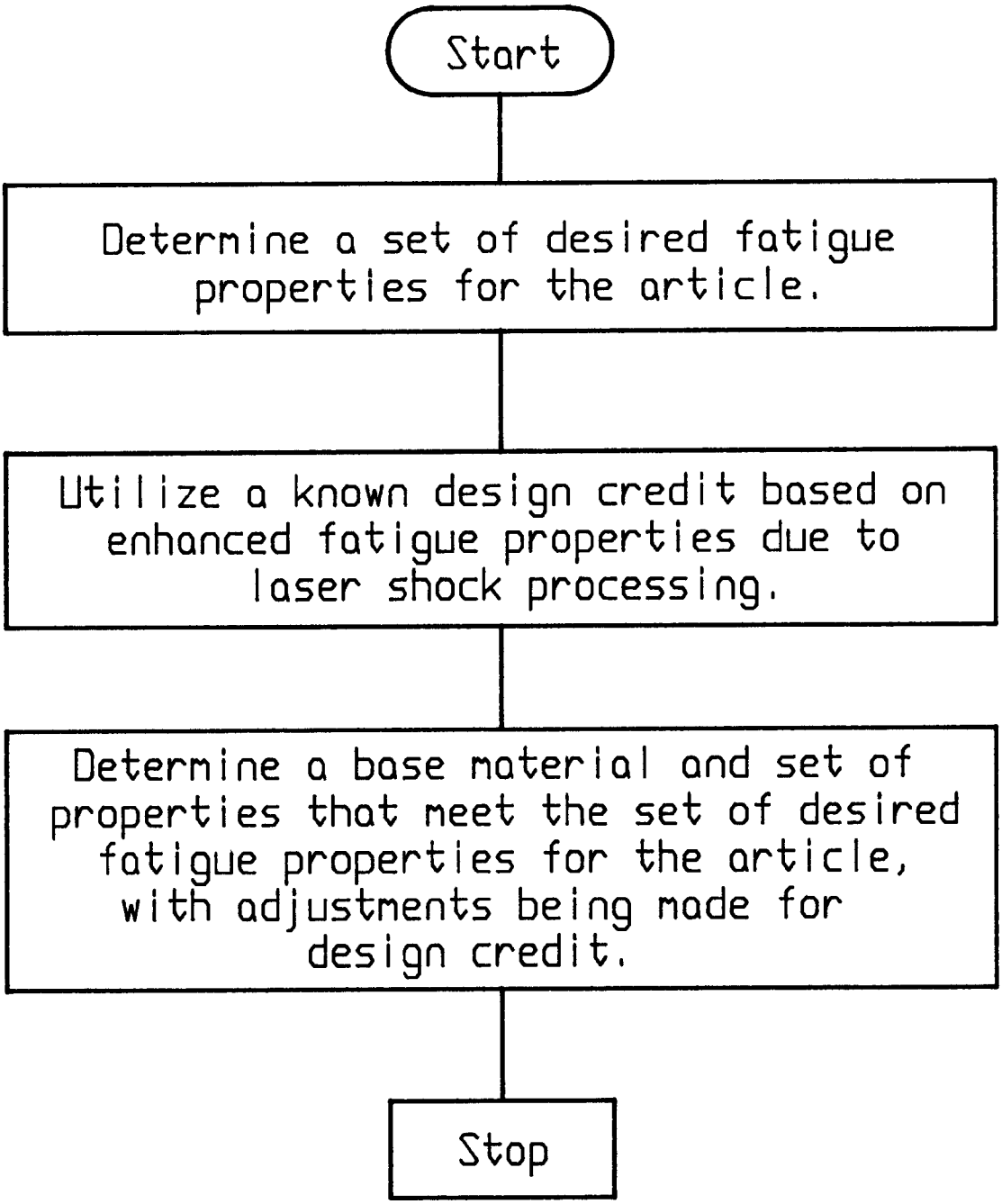
FIG. 2 is a flow chart indicating an alternative embodiment of the method of FIG. 1.

An alternative embodiment of the invention is shown in FIG. 2. According to this embodiment, an engineer or designer may skip the step of determining a first base material and associated physical and mechanical properties, especially when the design credit is known for a particular material. As shown in FIG. 2, the embodiment pertains to a method of designing an article of manufacture having material properties, comprising the steps of determining a set of desired fatigue properties for the article utilizing a known design credit based on enhanced fatigue properties due to laser shock processing, and determining a base material and set of properties that meet that set of desired fatigue properties for the article, with adjustments being made for design credit.

The invention, in yet another form thereof, pertains to a method of designing an article of manufacture having material properties, the method comprising the steps of determining a set of desired properties for the article based on preliminary design criteria, utilizing a known design credit based on enhanced properties of candidate materials for the article due to laser shock processing, determining an allowable increase in the design requirements for the article incorporating the design credit for the candidate materials, selecting the candidate material giving the highest allowable increase in the design requirements incorporating the design credit, and using the selected candidate material in the work piece.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of constructing a work piece having inherent fatigue property requirements, comprising the steps of:

determining a set of desired fatigue properties and tolerances for said work piece;

determining a first base material and a first set of properties that would satisfy said set of desired fatigue properties;

determining a second base material and a second set of properties that fall short of said set of desired fatigue properties;

determining a design credit for said second base material based on enhanced fatigue properties due to a laser shock peening process; and using said second base material in a work piece, said second base material having an enhanced set of properties that satisfy said set of desired fatigue properties by incorporating said design credit.

2. The method of claim 1, further providing said second base material is the same as said first base material.

3. The method of claim 1, further providing said second base material is a material having lower fatigue properties than said first base material.

4. The method of claim 1, wherein said step of determining a design credit comprises determining a value for an increase in the determined fatigue properties of said work piece due to said laser shock peening process, and calculating a resulting reduction in required base material.

5. The method of claim 1, further providing said design credit for a particular property is the difference between a non-laser shock processed material property value and a laser shock processed material property value.

6. The method of claim 1, further providing said work piece is one of a blade, a gear, a disk, a drive train component, and an Integrally Bladed Rotor (IBR).

7. The method of claim 1, further providing a weight measure of said second base material being less than a weight measure of said first base material.

8. The method of claim 1, further providing said first set of properties associated with said first base material defining a first workpiece performance measure, said second set of properties associated with said second base material defining a second workpiece performance measure, the second workpiece performance measure being comparatively inferior to the first workpiece performance measure.

9. The method of claim 1, further providing said workpiece defining a component of an engine, said engine exhibiting a thrust/weight ratio enhancement relative to a reference engine including a reference workpiece, the reference workpiece having no incorporation of said design credit therein.

10. A method of constructing an article of manufacture having material properties, comprising the steps of:

determining a set of desired fatigue properties for said article;

utilizing a predetermined design credit based on enhanced fatigue properties due to laser shock processing; and determining a base material and set of properties that meet said set of desired fatigue properties for said article, with adjustments being made for design credit.

11. The method of claim 10, further providing said article of manufacture is one of a blade, a gear, a disk, a drive train component, and an Integrated Blade and Rotor.

12. The method of claim 10, further providing a weight measure of said base material being less than a weight measure of a reference base material, the reference base material having a respective set of properties that meet said set of desired fatigue properties without any design credit adjustment being made thereto.

13. The method of claim 10, further providing the determined set of properties associated with said base material being comparatively inferior to a reference set of properties associated with a reference base material, the reference set of properties meeting said set of desired fatigue properties without any design credit adjustment being made thereto.

14. The method of claim 10, further providing said article defining a component of an engine, said engine exhibiting a thrust/weight ratio enhancement relative to a reference engine including a reference article, the reference article being formed without any design credit adjustment being made thereto.

15. A method of constructing an article of manufacture having material properties, comprising the steps of:

determining a set of desired properties for said article based on preliminary design criteria;

utilizing a predetermined design credit based on enhanced properties of candidate materials for said article due to laser shock processing;

determining an allowable increase in the design criteria for said article incorporating said design credit for the candidate materials;

selecting the candidate material giving the greatest allowable increase in the design crtiteria incorporating said design credit; and using the selected candidate material in the article.

16. The method of claim 15, further providing said article of manufacture is one of a blade, a gear, a disk, a drive train component, and an Integrated Blade and Rotor.

17. The method of claim 15, wherein a weight measure of said selected candidate material being less than a weight measure of a reference base material, the reference base material having a respective set of properties that meet said set of desired properties without incorporation of said design credit therein.

18. The method of claim 15, wherein the selected candidate material having unenhanced properties being comparatively inferior to reference properties associated with a reference base material, the reference properties meeting said set of desired properties without incorporation of said design credit therein.

19. The method of claim 15, wherein said article defining a component of an engine, said engine exhibiting a thrust/weight ratio enhancement relative to a reference engine including a reference article, the reference article having no incorporation of said design credit therein.

* * * * *